US009708888B2

(12) United States Patent
Allen

(10) Patent No.: US 9,708,888 B2
(45) Date of Patent: Jul. 18, 2017

(54) FLOW-ACTIVATED FLOW CONTROL DEVICE AND METHOD OF USING SAME IN WELLBORE COMPLETION ASSEMBLIES

(71) Applicant: Jason A. Allen, Houston, TX (US)

(72) Inventor: Jason A. Allen, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 330 days.

(21) Appl. No.: 14/530,394

(22) Filed: Oct. 31, 2014

(65) Prior Publication Data

US 2016/0123113 A1 May 5, 2016

(51) Int. Cl.

| | |
|---|---|
| ***E21B 34/14*** | (2006.01) |
| ***E21B 34/10*** | (2006.01) |
| ***E21B 33/12*** | (2006.01) |
| ***E21B 43/26*** | (2006.01) |

(52) U.S. Cl.

CPC ..... *E21B 34/10* (2013.01); *E21B 33/12* (2013.01); *E21B 34/108* (2013.01); *E21B 43/26* (2013.01)

(58) Field of Classification Search

CPC ..... E21B 33/12; E21B 34/10; E21B 34/102; E21B 34/12; E21B 34/125; E21B 34/108

USPC ..... 166/128, 133, 142, 319, 320, 332.1, 166/332.6, 332.7, 334.1

See application file for complete search history.

(56) References Cited

U.S. PATENT DOCUMENTS

| | | | | |
|---|---|---|---|---|
| 2,257,344 | A | 9/1941 | Maloney | |
| 2,565,742 | A | 8/1951 | Sailers | |
| 2,629,444 | A | 2/1953 | O'Donnell | |
| 3,302,722 | A | 2/1967 | Madely, Sr. | |
| 3,831,632 | A | 8/1974 | Young | |
| 4,128,105 | A | 12/1978 | Follett | |
| 4,428,428 | A | 1/1984 | Smyrl et al. | |
| 4,700,776 | A | 10/1987 | Petrovic | |
| 5,829,523 | A | 11/1998 | North | |
| 5,890,540 | A * | 4/1999 | Pia | E21B 21/10 166/321 |

(Continued)

FOREIGN PATENT DOCUMENTS

| | | | |
|---|---|---|---|
| GB | 2382828 | A | 6/2003 |
| WO | 2011028560 | A2 | 3/2011 |
| WO | 2011028563 | A3 | 3/2011 |

OTHER PUBLICATIONS

PCT International Search Report and Written Opinion; International Application No. PCT/US2015/057995; International Filing Date: Oct. 29, 2015; Date of Mailing: Jan. 25, 2016; pp. 1-14.

(Continued)

*Primary Examiner* — Kenneth L Thompson
(74) *Attorney, Agent, or Firm* — Cantor Colburn LLP

(57) ABSTRACT

A completion assembly for use in a wellbore is disclosed that in one non-limiting embodiment includes a tubular member having at least one packer to isolate a zone between the completion assembly and the wellbore, and a flow control device for closing flow of fluid through the tubular member, the flow control device including a valve that includes a fluid flow path and a seal member configured to close the fluid flow path, and a fluid-activated device that cycles each time a pressure differential is created across the flow path and moves the seal member to close the valve after completion of a selected number of cycles.

19 Claims, 4 Drawing Sheets

(56) References Cited

U.S. PATENT DOCUMENTS

| | | | | |
|---|---|---|---|---|
| 6,382,319 | B1 | 5/2002 | Hill, Jr. et al. | |
| 6,446,729 | B1 | 9/2002 | Bixenman et al. | |
| 6,464,006 | B2 | 10/2002 | Womble | |
| 6,568,472 | B1 | 5/2003 | Gano et al. | |
| 6,789,623 | B2 | 9/2004 | Hill, Jr. et al. | |
| 7,090,020 | B2 * | 8/2006 | Hill | E21B 23/006 166/191 |
| 7,331,388 | B2 | 2/2008 | Vilela et al. | |
| 7,357,198 | B2 * | 4/2008 | Mcgarian | E21B 21/103 166/319 |
| 7,543,647 | B2 | 6/2009 | Walker | |
| 7,950,454 | B2 | 5/2011 | Patel et al. | |
| 8,272,445 | B2 * | 9/2012 | Fay | E21B 23/006 137/625.48 |
| 8,596,368 | B2 * | 12/2013 | Frosell | E21B 23/006 166/321 |
| 8,770,292 | B2 | 7/2014 | McClung, III | |
| 8,978,775 | B2 * | 3/2015 | Lindsay | E21B 23/006 166/240 |
| 9,267,345 | B2 * | 2/2016 | Grande | E21B 23/006 |
| 2004/0140089 | A1 | 7/2004 | Gunneroed | |
| 2005/0082060 | A1 | 4/2005 | Ward et al. | |
| 2005/0156131 | A1 | 7/2005 | Holliday | |
| 2007/0068675 | A1 | 3/2007 | Barry et al. | |
| 2008/0099194 | A1 | 5/2008 | Clem | |
| 2008/0314591 | A1 | 12/2008 | Hales et al. | |
| 2009/0294177 | A1 | 12/2009 | Chan et al. | |
| 2010/0200245 | A1 | 8/2010 | Ringgenberg et al. | |
| 2011/0056686 | A1 | 3/2011 | Clem | |
| 2011/0067886 | A1 | 3/2011 | Moen | |
| 2011/0209919 | A1 | 9/2011 | Aros | |
| 2012/0085548 | A1 | 4/2012 | Fleckenstein et al. | |
| 2012/0097397 | A1 | 4/2012 | Hofman et al. | |
| 2012/0103608 | A1 | 5/2012 | Van Petegem et al. | |
| 2012/0118579 | A1 | 5/2012 | Murray et al. | |
| 2012/0261131 | A1 * | 10/2012 | Hofman | E21B 34/14 166/316 |
| 2014/0246206 | A1 | 9/2014 | Least et al. | |

OTHER PUBLICATIONS

PCT International Search Report and Written Opinion; International Application No. PCT/US2014/050334; International Filing Date: Aug. 8, 2014; Date of Mailing: Nov. 27, 2014; pp. 1-11.

* cited by examiner

FLOW-ACTIVATED FLOW CONTROL DEVICE AND METHOD OF USING SAME IN WELLBORE COMPLETION ASSEMBLIES

BACKGROUND

1. Field of the Disclosure

This disclosure relates generally to completion assemblies or strings used in treating production zones and for producing formation fluids.

2. Background of the Art

Wellbores are drilled in subsurface formations for the production of hydrocarbons (oil and gas). Hydrocarbons are trapped in various sections or traps in the subsurface formations at different depths. Such sections are referred to as reservoirs or hydrocarbon-bearing formations or zones. Often multiple spaced-apart zones exist along wellbores, several hundred feet apart from each other. Stimulation methods are often employed to improve the mobility of the hydrocarbons through the production zones. One such method, referred to as fracturing (also referred to as "fracing" or "fracking"), is often employed to create cracks in the reservoir, enabling the fluid from the formation (formation fluid) to flow from the reservoir into the wellbore. A majority of wellbores are lined with a casing and contain a sump packer below the lowest zone. To treat the zones, a completion assembly having a number of devices corresponding to each zone, such as packers, valves and sand screens, etc., is run into the wellbore. The bottom end of the completion assembly is stabbed into the sump packer to provide tubing isolation to set the packers against the casing. In open-hole well systems, no sump packer is available to isolate the tubing of the completion assembly to set the packers against the formation. Therefore, there is a need to provide a device below the lowermost packer in a completion assembly that will remain open when the completion assembly is run into the wellbore and that can be closed once the completion assembly has been run to a desired wellbore depth, in order to set the packers to isolate the production zones prior to treating such zones.

The disclosure herein provides a completion assembly that includes a flow control device that may be activated after the assembly has been run into the wellbore to a desired depth.

SUMMARY

A completion assembly for use in a wellbore is disclosed that in one non-limiting embodiment includes a tubular member having at least one packer to isolate a zone between the completion assembly and the wellbore and a flow control device for closing the flow of a fluid through the tubular member, the flow control device including a valve that includes a fluid flow path and a seal member configured to close the fluid flow path, and a fluid-activated device that cycles each time a pressure differential is created across the fluid flow path and moves the seal member to close the valve after completion of a selected number of cycles.

The disclosure further provides a method of completing a wellbore that in one-non-limiting embodiment includes: providing a completion assembly that includes a tubular member having at least one packer to isolate a zone between the completion assembly and the wellbore and a flow control device below the at least one packer for closing the flow of a fluid through the tubular member, wherein the flow control device includes a valve having a fluid flow path and a seal member configured to close the fluid flow path and a fluid-activated device that cycles each time a pressure differential is created across the fluid flow path and moves the seal member to close the valve after completion of a selected number of cycles; running in the completion assembly in the wellbore with the valve in an open position; and creating pressure differential across the fluid flow path a selected number of times to close the flow of the fluid through the tubular.

Examples of the more important features of a well treatment system and methods that have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
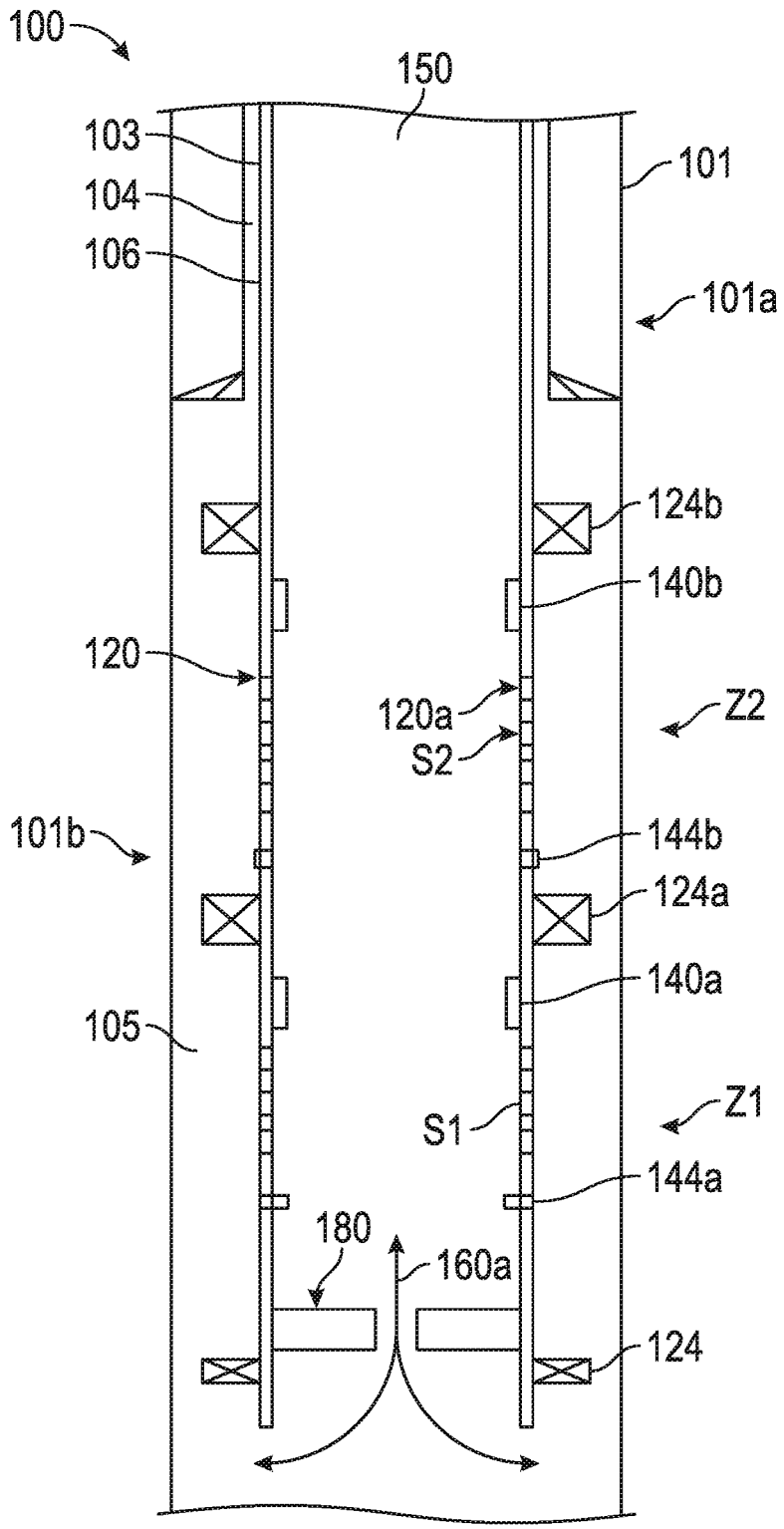
FIG. 1 shows an exemplary open-hole multi-zone wellbore system with a completion assembly run into the wellbore that includes a flow control device to isolate the completion assembly from the annulus between the completion assembly and the wellbore, according to one non-limiting embodiment of the disclosure.

FIG. 1 is a line diagram of an open hole wellbore system 100 that includes a wellbore 101 formed in formation 102 for performing a treatment operation therein, such as fracturing the formation (also referred to herein as fracing or fracking), gravel packing, flooding, etc. An upper section 101*a* of the wellbore 101 is lined with casing 104 and the annulus 103 between the casing 104 and the wellbore 101 is filled with cement 106 to stabilize the upper section 101*a* of the formation 102. The lower section 101*b* of the wellbore 101 below the casing 104 is an open hole. The wellbore 101 may include any number of production zones. For explanation purposes only and not as any limitation, the wellbore 101 is shown to include two zones: a lower zone Z1 and an upper zone Z2. To treat the zones Z1 and Z2, a completion assembly 120 is run in or placed in the wellbore 101 to a suitable depth. In one non-limiting embodiment, the completion assembly 120 includes a lower packer 124 proximate to a bottom end 120*a* of the completion assembly 120 and an isolation packer corresponding to each zone for isolating its associated zone from the other zones. In FIG. 1, zone Z1 is shown to include an isolation packer 124*a* and zone Z2 an isolation packer 124*b*. The completion assembly 120 includes a sand screen S1 below packer 124*a* corresponding to zone Z1 and screen S2 below packer 124*b* corresponding to zone Z2. A monitoring valve 144*a* in the screen assembly S1 provides fluid communication between the formation 102 and inside 120*a* of the completion assembly 120 for zone Z1 and a monitoring valve 144*b* in the screen assembly S2 provides fluid communication between the formation 102 and inside 120*a* of the completion assembly 120 for zone Z2. A valve, such as a sleeve valve also referred to as frac sleeve 140*a* is provided between the packer 124*a* and the screen S1 for supplying a treatment fluid to zone Z1 while a frac sleeve 140*b* is provided for supplying the treatment fluid to zone Z2. For hydraulically-set packers the inside 120*a* of the completion assembly 120 is pressurized by a fluid 150 from the surface. However, prior to such treatment operation, it is necessary to stop flow of any fluid through the completion assembly 120 so that the fluid supplied under pressure to the completion assembly 120 will act on the hydraulically-activated packers 124*a* and 124*b* to set such packers. Also, during run in of the completion assembly 120 into the well bore 101, forward flow of the fluid is necessary, i.e., it is necessary that the fluid 150 flows through the completion assembly, as shown by arrows 160. The present disclosure provides a fluid-activated flow control device 180 below the isolation packers that remains open when the completion assembly 120 is run into the wellbore 101 and which can be closed after the completion assembly 120 has been placed or run into the wellbore to the desired depth. A non-limiting embodiment of a flow control device for use in a completion assembly, including, but not limited to the completion assembly 120 of FIG. 1, is described in reference to FIGS. 2-4.

Figure 2:
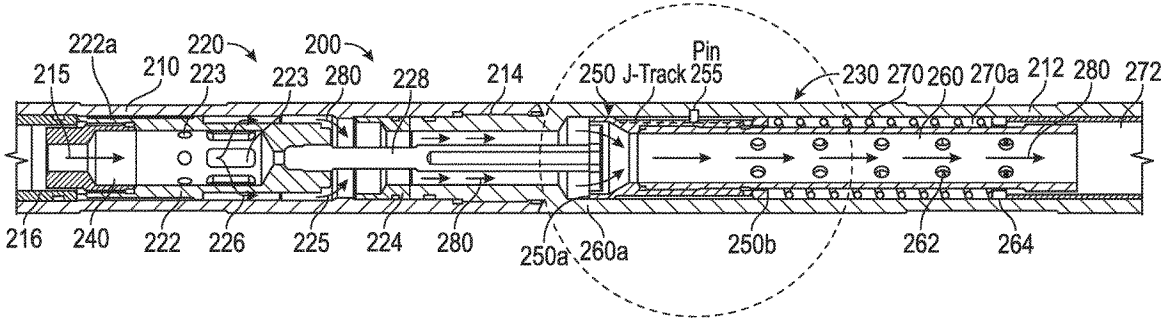
FIG. 2 shows an non-limiting embodiment of a flow control device in an open position for use in a completion assembly, such as completion assembly of FIG. 1, for isolating the annulus between the completion assembly and an open hole wellbore.
Figure 2A:
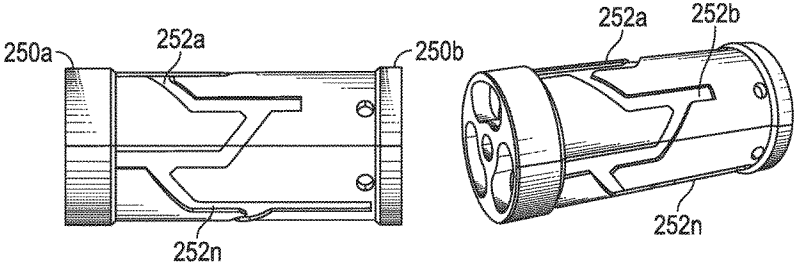
FIG. 2A shows an exemplary cycling device that may be utilized in the flow control device of FIG. 2 to close the flow of a fluid through the completion assembly after a selected number of pressure cycles.
Figure 4:
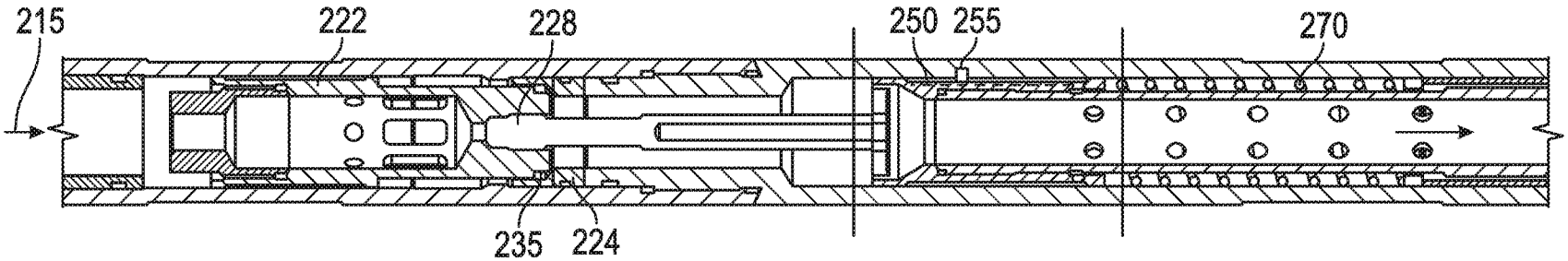
FIG. 4 shows the flow-activated device of FIG. 2 in the closed position.

FIG. 2 shows a non-limiting embodiment of a flow-control device 200 (also referred to herein as the "reversing valve") in an open position for use in a completion assembly, such as completion assembly 120 of FIG. 1, for isolating annulus 105 between the completion assembly 100 and wellbore 101. FIG. 2A shows a flow-activated cycling device 250 for use in closing the flow control device 200 after a selected number of pressure cycles. Referring now to FIGS. 2 and 2A, the device 200 includes an upper housing 210 connected to a lower housing 212 at a connection 214, such as threads. The upper housing 210 may be coupled to a suitable location in the completion string 100 by a top sub 216. The device 200 includes a valve 220 and a valve closing device or flow closing device 230. In one embodiment, the valve 220 includes a valve body 222 and a closing member such as seal 224, separated from the valve body 222 by a closable gap 225. A nozzle 240 at an upper end 222*a* of the valve body 222 provides a fluid path 215 from a location uphole of the device 200 to the valve body 222. The valve body 222 includes a number of radial openings 223 that allow a fluid to flow out of the valve body as shown by arrows 226. In the open position, the gap 225 between the valve body 222 and the seal member 224 exists (i.e., is open), while in the closed position, the gap 224 is closed, as shown in FIG. 4. The closing device 230 includes a mandrel 260 inside the lower housing 212 that includes fluid openings 262, such as in the form of holes or slots. The closing device 230 further includes a hydraulically-activated closing device or mechanism that in one non-limiting embodiment includes a slot-pin device or cycling device that includes a j-slot locking cap or lock cap 250 and a pin 255. The lock cap 250 includes a number of longitudinal slots 252*a*, 252*b* . . . 252*n* that move about the pin 255. At least one slot, such as slot 250*n*, corresponds to the closing position of the flow control device 200 while the remaining slots, such as slots 250*a*, 250*b*, etc., correspond to the open position or partially open position of the flow control device 200 as described later. The pin 255 is fixed to the outer housing 212 while the lock cap 250 moves axially and radially as the slots 250*a*-250*n* move about the pin 255. The lock cap 250 is placed on an upper end 260*a* of the mandrel 260 and it moves about the pin 255 when pressure above a certain threshold is applied to the upper end 250*a* of the lock cap 250 (i.e., when a pressure differential above a certain threshold is created across the lock cap 250). A biasing member, such as a spring 270, between the lower end 250*b* of the locking cap 250 and a spring retainer 272 applies a constant upward force to the lock cap 250. A bearing 264 may be provided between the spring retainer 272 and the lower end 270*a* of the spring 270. When the seal member 224 is separated from the valve body 222, the valve is open and the valve is closed when the seal member 224 is pressed against the valve body 222. In the open position fluid flows through the device 200 as shown by arrows 280 and no fluid or minimal fluid flows through the device 200 when the valve is closed. The valve body 222 is connected to the lock cap 250 by a member, such as rod 228.

Figure 3:
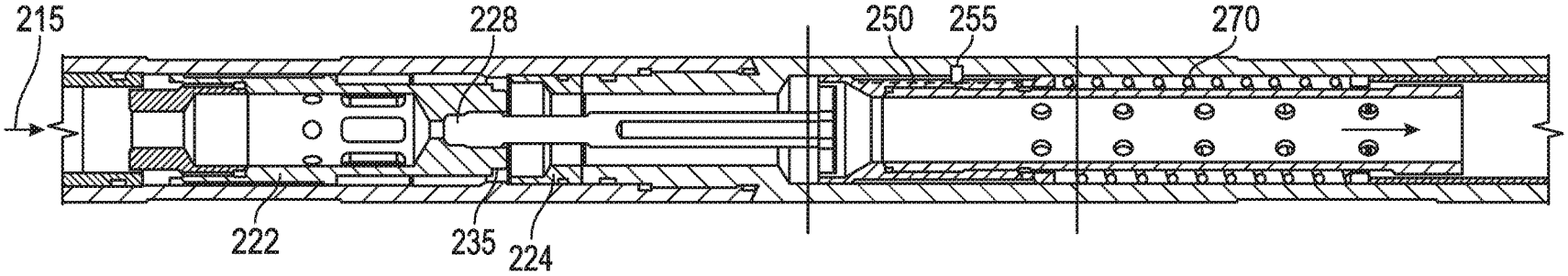
FIG. 3 shows the flow-activated device of FIG. 2 in an intermediate position.
Figure 3A:
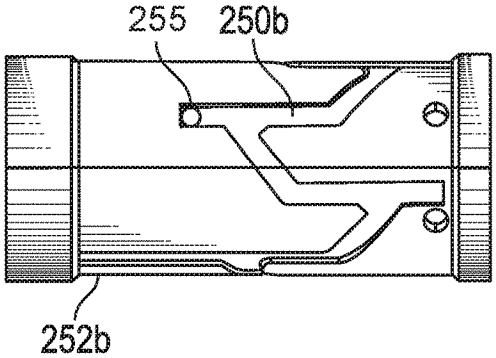
FIG. 3A shows the position of the pin in a slot of the cycling device when the flow control device is in an intermediate or partially closed position as shown in FIG. 3.
Figure 4A:
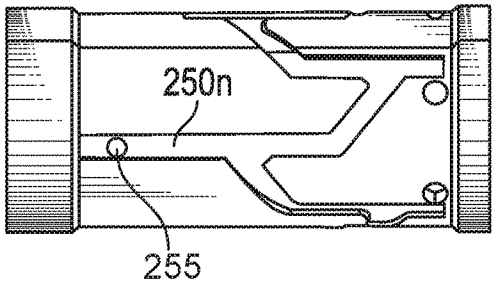
FIG. 4A shows the position of the pin in a slot of the cycling device when the flow control device is in the closed position as shown in FIG. 4.

Referring to FIGS. 3 and 3A, when fluid 215 supplied under pressure exceeds a certain or selected threshold, the valve body 222 moves downward, causing the connecting member 228 to move the lock cap 250 downward, compressing the spring 270. In the configuration of FIG. 2, the lock cap 250 will move axially downward and rotate as the slot or track 250*b* moves about the pin 255. The lock cap 250 will stop moving when the pin 255 is at the bottom end 252*b* of the slot 250*b*. The valve body 222 will move toward the seal member 224 a certain distance, as shown in FIG. 3. When the pressure is released, the spring 270 will cause the lock cap 250 to attain a position in one of the non-closing slots, as shown in FIG. 2, thereby creating the gas 224 as shown in FIG. 2. Each time the pressure is increased and reduced (cycled), the lock cap 250 will move about the pin 255 to attain the partially closed position as shown in FIG. 3 and then the open position of FIG. 2. If, for example, there are four non-closing slots, such as slots 250*a*, 250*b* and followed by a closing slot, such as slot 250*n*, then for the first four pressure cycles, the lock cap 250 will move between open position of FIG. 2 and partially closed position of FIG. 3. On the next pressure cycle, the lock cap 250 will move about the closing slot 250*n*, which is longer than the non-closing slots, thereby causing the seal member 228 to seal the valve body 222 as shown in FIG. 4. The position of the pin 255 in the closing slot 250*n* is shown in FIG. 4A. Releasing the pressure on the valve body 222 will not cause the spring 270 to move the lock cap upward as the pin 255 cannot move out of the extended slot 250*n*, thereby permanently closing the flow of the fluid 215 through the flow control device 200 and thus the completion assembly 120 shown in FIG. 1. In some embodiments, a delay device or mechanism may be provided to delay the application of the fluid pressure on the valve 220 (i.e., the device will not cycle to the next slot until a threshold rate is created and maintained for a specified period of time 220). A delay device may be coupled to the flow control device 200 in any suitable manner to delay each cycle of the closing device by a selected or predetermined time period. Delay devices, including metering devices, are available in the art and are thus not described herein.

Referring back to FIG. 1, to perform a treatment operation for a zone, such as zone Z1, the flow control device 180 is closed as described above and the packer 124 and 124*a* are set to isolate zone Z1 from the other zones. A service string or assembly (known in the art and thus not shown) is placed inside the completion assembly 120 and manipulated to open the monitoring valve 144*a* to establish fluid communication between the formation 101 and inside 120*a* of the completion string 120. The frac sleeve 140*a* is opened to provide fluid communication from inside 120*a* of the completion assembly 120 to the zone Z1. A treatment fluid, such as slurry or another fluid is supplied under pressure to zone Z1 via the service string and the frac sleeve 140*a*. After the treatment operation is complete the monitoring valve 144*a* and the frac sleeve 140*a* are closed. The next zone, such as zone Z2 is then treated in the manner described above for zone Z1. Such treatment operations are known in the art and are thus not described in detail herein.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A completion assembly for use in a wellbore, comprising:

a tubular member including at least one packer to isolate a zone between the completion assembly and the wellbore; and a flow control device for closing flow of a fluid through the tubular member, the flow control device including:

a valve that includes a fluid flow path and a seal member configured to close the fluid flow path; and a fluid-activated device that cycles each time a pressure differential is created across the flow path and moves the seal member to close the valve after completion of a selected number of cycles, wherein the fluid-activated device includes a locking cap having a plurality of non-closing slots and at least one closing slot, wherein the plurality of non-closing slots move axially about a pin without closing the flow path and move the seal member to close the flow path when the at least one closing slot moves about the pin.

2. The completion assembly of claim 1, wherein the pressure differential is created by supplying a fluid under pressure into the tubular.

3. The completion assembly of claim 1, wherein the flow control device remains open when the completion assembly is run into the wellbore and closes only after the fluid-activated device has cycled the selected number of cycles.

4. The completion assembly of claim 1, wherein the flow control device includes a delay device that delays cycling by a selected time period.

5. The completion assembly of claim 1 further comprising a sand screen below the at least one packer, a frac sleeve between the at least one packer and the sand screen for treating a formation zone in the wellbore with a treatment fluid.

6. The completion assembly of claim 1, wherein the valve closes permanently after completion of the selected number of cycles.

7. The completion assembly of claim 1, wherein applying a predetermined pressure on uphole side of the flow control device causes the plurality of non-closing slots to move axially about the pin without closing the flow path and move the seal member to close the flow path when the at least one closing slot moves about the pin.

8. The completion assembly of claim 7, wherein the fluid-activated device includes a biasing device that returns lock cap to an initial position when the pressure differential is released from across the flow path.

9. The completion assembly of claim 8, wherein the delay device is a hydraulically-operated metering device.

10. A method of completing a wellbore, the method comprising:

providing a completion assembly that includes a tubular member having at least one packer to isolate a zone between the completion assembly and the wellbore, and a flow control device for closing flow of fluid through the tubular member below the at least one packer that further includes a valve having a fluid flow path and a seal member configured to close the fluid flow path and a fluid-activated device that cycles each time a pressure differential is created across the fluid flow path and moves the seal member to close the valve after completion of a selected number of pressure cycles;

running in the completion assembly in the wellbore with the valve in an open position; and creating pressure differential across the fluid flow path a selected number of times to close the valve to close the flow of the fluid through the tubular, wherein the fluid-activated device includes a locking cap having a plurality of non-closing slots and at least one closing slot, wherein the plurality of non-closing slots move axially about a pin without closing the flow path and move the seal member to close the flow path when the at least one closing slot moves about the pin.

11. The method of claim 10 further comprising running the completion assembly into the wellbore to a depth in the wellbore for performing a treatment operation before creating the pressure differential a selected number of times.

12. The method of claim 10, wherein creating the pressure differential comprises:

supplying a fluid under pressure into the tubular above a selected threshold and releasing the pressure a plurality of times.

13. The method of claim 10 further comprising running in the completion assembly into the wellbore with the flow control device in an open position.

14. The method of claim 10, wherein the completion assembly further comprises a sand screen below the at least one packer, a frac sleeve between the at least one packer and the sand screen for treating a formation zone in the wellbore with a treatment fluid and wherein the method further comprises:

setting the at least one packer to isolate a zone of a formation surrounding the completion assembly after closing the flow of the fluid through the tubular; and supplying a treatment fluid to the isolated zone via the frac sleeve to treat the isolated zone.

15. The method of claim 10 further comprising permanently closing the fluid flow path after the selected number of cycles.

16. The method of claim 10, wherein the method further comprises applying a predetermined pressure on the uphole side of the flow control device to cause the plurality of non-closing slots to axially move about the pin without closing the fluid flow path and then causing the closing slot to move about the pin to close the fluid flow path.

17. The method of claim 16, wherein the fluid-activated device includes a biasing device that returns the lock cap to an initial position for each of the non-closing slots and locks the locking cap after the closing slot has moved through the pin.

18. The method of claim 16, wherein the flow control device includes a delay device that delays cycling by a selected time period.

19. The method of 16, wherein the delay device is a hydraulically-activated metering device.

* * * * *